US008220655B2

(12) United States Patent
Millstein

(10) Patent No.: US 8,220,655 B2
(45) Date of Patent: Jul. 17, 2012

(54) HANGING TRAY FOR SINGLE OPEN BEVERAGE

(76) Inventor: Joshua Millstein, Seattle, WA (US)

( * ) Notice: Subject to any disclaimer, the term of this patent is extended or adjusted under 35 U.S.C. 154(b) by 0 days.

(21) Appl. No.: 12/819,204

(22) Filed: Aug. 30, 2010

(65) Prior Publication Data

US 2012/0048772 A1 Mar. 1, 2012

(51) Int. Cl.
*B65D 90/12* (2006.01)

(52) U.S. Cl. ..... 220/636; 220/737; 248/310; 248/311.2; 248/318; 248/328; 294/142; 294/144

(58) Field of Classification Search ..... 220/636, 220/737; 248/310, 311.2, 318, 328; 294/142, 294/144

See application file for complete search history.

(56) References Cited

U.S. PATENT DOCUMENTS 4,943,025 A * 7/1990 Warner ..... 248/318
D337,226 S * 7/1993 Rosenbaum ..... D6/513
D367,998 S * 3/1996 Graw et al. ..... D7/620

* cited by examiner

*Primary Examiner* — Anthony Stashick
*Assistant Examiner* — Elizabeth Volz

(57) ABSTRACT

A suspended tray apparatus for avoiding spillage while carrying a single open container of liquid such as a mug of coffee or a cup of tea. The apparatus of the present invention is comprised of a tray on which the beverage is placed and a rigid element extending from the side of the tray and curved such that the outer end is centered above the tray and container; a hole or other method of attaching a cord or chain to the upper end of the rigid element, allowing the tray to hang from a loop or handle, held by a person, at the upper end of the chord or chain.

2 Claims, 2 Drawing Sheets

HANGING TRAY FOR SINGLE OPEN BEVERAGE

BACKGROUND OF THE INVENTION

1. Field of the Invention

The present invention relates to devices that are designed for hand-carrying beverages in open containers while avoiding spillage by means of a suspension system.

2. Description of Prior Art

A variety of devices have been designed to minimize spillage while transporting open beverages by suspending an apparatus holding beverage containers from a handle, which is held from above by the carrier. Not only is this an ergonomically natural way to carry an object, but it has been noted that spillage is more easily controlled than a method by which beverages are held in a more rigid fashion as from below. When using the latter method spillage generally occurs due to a lateral (usually unintended) acceleration of the beverage container initiated by the carrier. The liquid inside the container responds to this acceleration by 'sloshing' up and sometimes over the wall of the container, causing spillage. Suspension of the container from above by a flexible support reduces the capacity of the carrier to induce a lateral acceleration in the container by a lateral acceleration in the handle of the apparatus. In the suspended arrangement just described, a lateral acceleration of the handle translates to a swinging motion and ultimately an acceleration of the liquid at least partially from below, which does not tend to cause 'sloshing'. Gravity simultaneously acts on the tray, the container, and the liquid inside the container, to bring the system back to equilibrium, a state where the center of mass is directly below the handle, which translates to an upright orientation of the container.

Some recently designed devices are well suited for carrying multiple hot liquid disposable cups that are produced in standard sizes and shapes as used by coffee venders. For instance, the Cup Carrier designed by Libit et al. (Pub. No. US 2008/0087558) includes a a base with a plurality of openings for receiving beverage cups, where the base is suspended by a handle structure above such that the force of gravity will maintain the cup or cups in an upright position. The cups must be small enough to fit into the openings but not so small that they fall through the openings. This design is well suited for disposable type conical shaped hot cups, but not ceramic coffee or tea mugs that often have attached protruding handles and come in many diverse shapes and sizes.

Another example is the Convertible Cup Holder (Pub. No. US 2009/0126149), which includes an insulating sleeve that slides around a hot beverage cup, where the sleeve includes attached strings that extend above the cup and function has handles for suspending the cup in a hanging modality. As is the case for the Cup Carrier, the Convertible Cup Holder is well suited for disposable type conical shaped hot cups, but not ceramic style coffee or tea mugs. A related design is the Configurable Cup Holder (Pub. No. US 2005/0241964), which employs a carrier blank as a loop with an opening at one side of the loop for a cup to slide into and a handle on the other side from which the cup is suspended.

An example of a more general apparatus is the Pendulous Beverage Server (5,573,136) of Page, which employs a tray with recessed cavities into which open containers of liquids can be placed. The tray is suspended from the center by a retractable chord that is attached to a handle held from above by the server. Like the proposed apparatus, the tray is attached to the handle by a flexible element; however, the Page design is better suited to a plurality of open containers rather than a single container. The Page tray is suspended from the center; therefore a single open container resting to the side of the central tower will cause a listing of the tray and may result in some spillage. The retracting handle of the Page tray addresses a potentially problematic issue that could occur with a previous related invention, Rienzo's (4,117,965) Self-Balancing Tray. The Self-Balancing Tray also includes a flexible element attached to a handle, which is used to suspend the tray from above, however, the handle is not retracting so may hang down below and interfere with the containers placed on the tray when the tray is at rest on a surface and the handle is not in use. The Self-Balancing Tray is suspended by an arched support structure that is attached to the tray in two places, which are opposing sides of the tray.

OBJECTS AND ADVANTAGES

The object of the present invention is to provide a means by which an individual may hand-carry an open liquid filled container such as a mug of coffee or tea or a bowl of soup a substantial distance without excessive risk of spillage. An appropriate usage and environment would be an office building in which an individual must walk with an open container of liquid, such as a personal mug or bowl of hot coffee, tea, or soup, from a vendor or kitchen area to a personal office. The present invention includes a small tray with a flat upper surface, which provides a receptacle for a wide variety of open mugs, cups, or bowls that may include protruding handles for transporting liquids such as coffee, tea, or soup. A single rigid extending element extends from the side of the tray and above the region where the container is placed and articulates with a loop of cord or other means by which the carrier may suspend the apparatus in a flexible manner. When not in use the loop of cord may rest upon the extending element, thus avoiding any interference with a container of liquid placed on the tray. I have found that sides on the tray are not necessary, as there is no lateral force to cause the container to slide on the tray. The present invention is elegant in its simplicity and efficient in that only a single attachment point from the tray to the extending element is required for the supporting tray. A single attachment point also facilitates the ease of placing the container on the tray. That is, a single attachment point results in fewer obstacles when placing the container on the tray than would be present if there were two attachment points as is the case for the Self-Balancing Tray. Additionally, the proposed invention includes as a handle a small loop of cord or similar arrangement at the end of the rigid extending element, thus, there is no need for a retracting cord and handle and no risk of a handle interfering with the liquid-filled container. The loop of cord or other material articulates with the suspending element in a very flexible manner, thus allowing the tray apparatus to swing freely in any direction which minimizes the risk of spillage.

SUMMARY OF THE INVENTION

The apparatus of this invention comprises:

a tray, a rigid extending element affixed to and extending from the side of the tray and above; a configuration of rigid or flexible handle element mounted to said extending element by means of an opening or other means by which said handle material may freely articulate with and suspend the extending element, the articulation point being centered above the tray and higher than the height of a typical mug or open beverage container.

It will usually be desirable that the tray diameter is slightly larger than the diameter of a large mug or small soup bowl.

The bottom and top of the tray should be moderately flat to insure that the tray rests in a stable manner on a flat surface and a typical open beverage container rests in a stable manner on the tray. However, it may be desirable for the edges of the tray to curve upward somewhat to contain any small amount of spillage that may occur, as when placing the beverage container on the tray.

The handle configuration should be such that the articulation point of the handle element with the extending element should be directly above the center of mass of the apparatus with a typical container and beverage resting on the tray. This arrangement insures a level equilibrium when the tray apparatus is suspended. The articulation should also be as free as possible, for it is the swinging motion that absorbs any lateral acceleration and translates it to vertical acceleration, which does not tend to cause spillage.

The tray and extending element could be molded or formed from any rigid material such as plastic or ceramic. If a brittle material such as ceramic is used, it may be helpful to include metal scaffolding within the extending element to increase strength.

Alternatively, the tray and extending element could be constructed from a combination of ceramic forming the tray, and metal forming the extending element.

The handle could be formed from a flexible material such as a loop of cord or leather or a rigid material such as a loop of heavy gage wire.

The effectiveness of the described apparatus for avoiding spillage and even moderate perturbations in the surface of the liquid is so striking that carrying a liquid-filled container is actually an entertaining visual experience.

DETAILED DESCRIPTION

A single embodiment of the invention will now be described in detail, with reference to the accompanying drawings, wherein.

Figure 1:
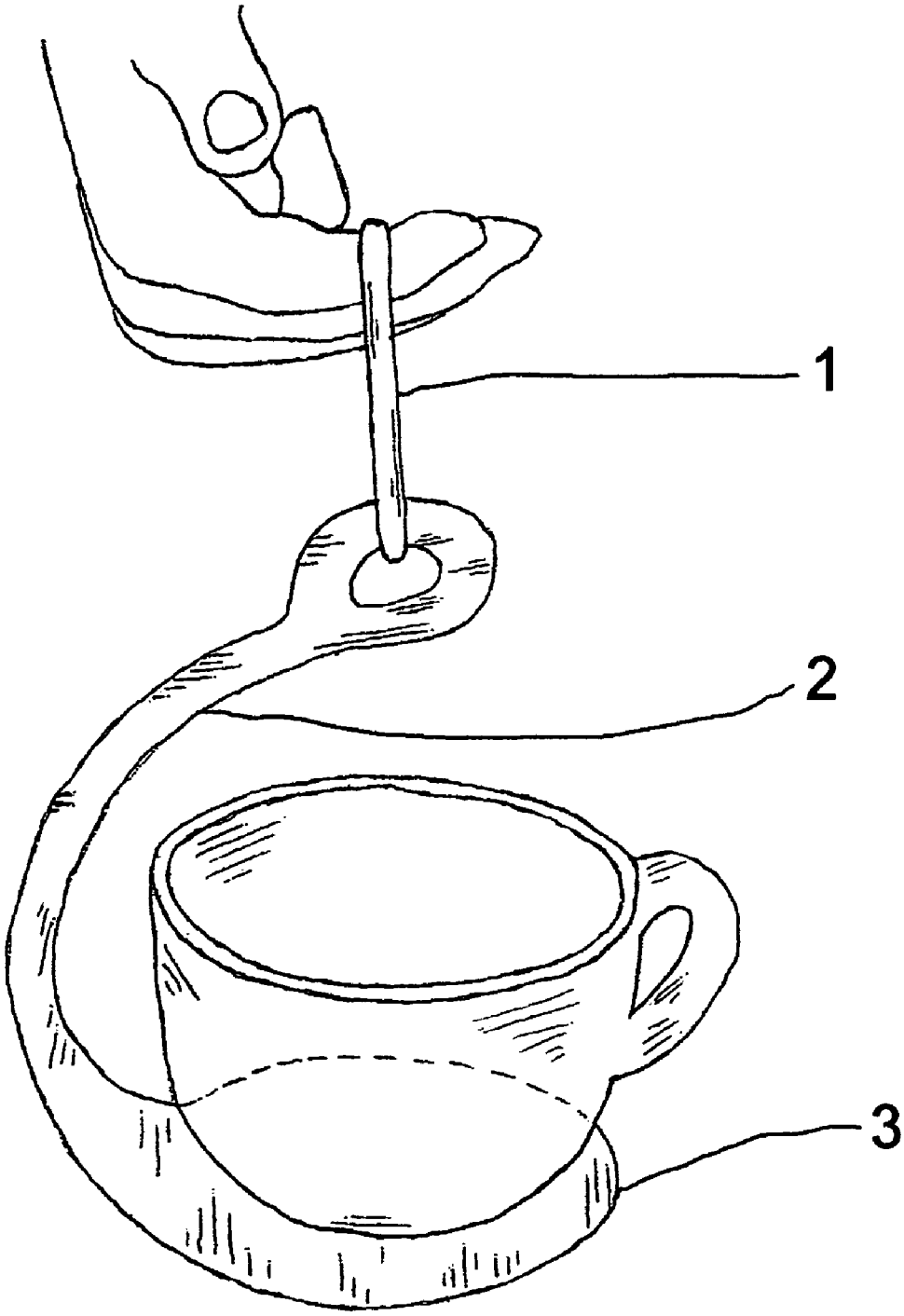
FIG. 1 is a perspective view of the preferred embodiment of the apparatus according to the invention.
Figure 2:
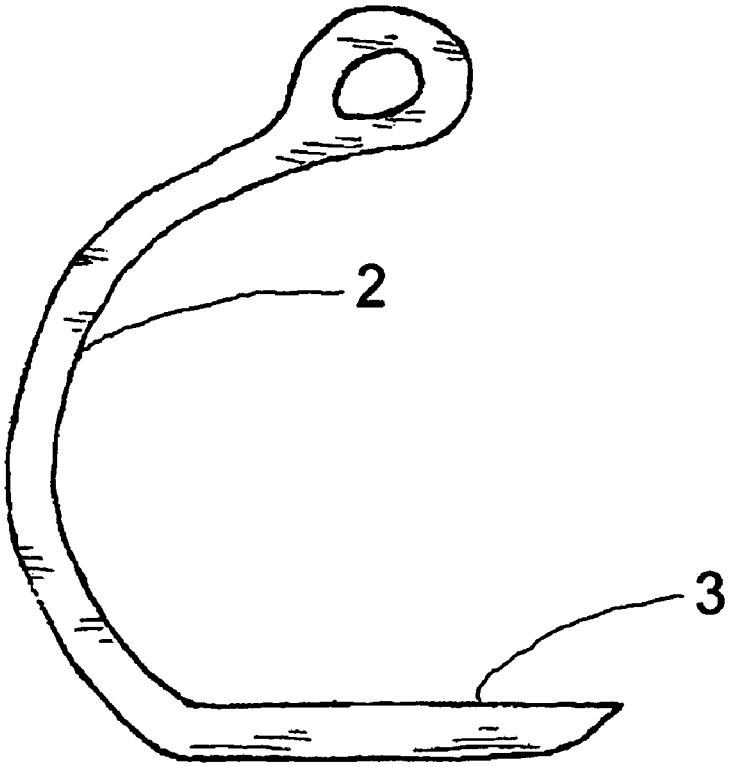
FIG. 2 is a side view (upper) and top view (lower) of the preferred embodiment of the tray and the extending element of the apparatus.
Figure 2:
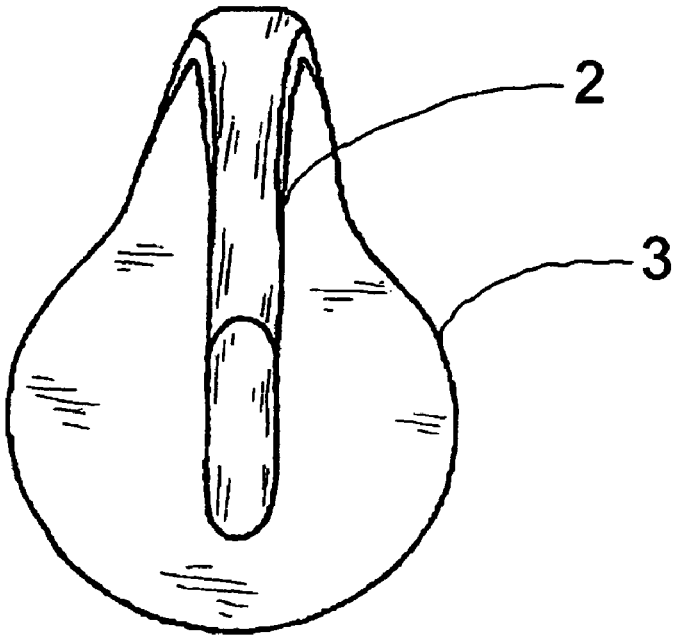

The apparatus has a handle, an extending element, and a tray, shown generally as 1, 2, and 3, respectively, in FIG. 1. The tray is large enough to accommodate a ceramic-type mug or a small bowl and may have edges that are slightly rising up as is the case for a typical saucer, which is designed to prevent small amounts of spilled liquid from flowing over the edge of the tray. However, sides are not necessary for the tray of the invention, because gravity will ensure that the tray tends to hang in a level orientation, and when the apparatus is out of a level equilibrium state, such as if swinging during transport, then gravity exerts a restorative force simultaneously on both the tray and container. That is, there is not likely to be a force acting individually on the container relative to the tray. The implication is that slippage of the container relative to the tray is unlikely and thus tray sides are unnecessary.

The tray is rigidly attached to the extending element, which rises above the tray and functions as a structural support to suspend the tray in a level orientation from the handle. In the preferred embodiment, the tray and extending element are constructed as a single unit, such as by plastic injection molding. It is important that the attachment point of the extending element to the tray is located at the side of the tray to avoid interference with the container, which is usually placed at the center of the tray. Additionally, it is preferred that the extending element angle away from the tray to accommodate containers with sides that flare outward such as soup bowls. It is important that the strength of the extending element is sufficient to rigidly support the weight of a full container of liquid while in transport.

In the preferred embodiment, the handle is flexibly attached to the extending element by linking to a hole in the end of the extending element. Alternatively, a fixed attachment as by embedding the handle in the extending element material or any other means by which the handle is flexibly attached to the extending element, will achieve a similar effect. It is important that the flexible attachment point that connects the extending element to the handle is centered above the tray, in order to insure that the container hangs in a level orientation. If heavy materials are used for the tray and extending elements, such as solid metal or ceramic, then some offsets to the attachment point between the extending element and handle may be required, depending on the weight distribution, to ensure a level orientation of a typically weighted liquid-filled container.

In the preferred embodiment, the handle is simply a loop of thick cord or small diameter rope that runs through the hole in the end of the extending element. The preferred diameter of the rope is small enough to allow sufficient flexibility in the rope to accommodate an inconspicuous knot used to join the ends of the loop, however, the diameter is large enough to provide a comfortable means of suspending the apparatus by one or several fingers. The preferred length of the loop is long enough to comfortably slide two or three fingers through for carrying but not so long that the loop hangs down in the container when the apparatus is at rest on a supporting surface with a liquid-filled container resting on the tray. When the apparatus is at rest on a supporting surface, the loop can be laid back on the extending element, thus decreasing the likelihood of interference with the container and liquid. Moreover, rope with some stiffness is less likely to hang down and interfere with the container if the loop is laid back to rest on the extending element.

Alternative materials for the handle could be leather, wood, or metal. In fact, any material that flexibly articulates with the extending element at a point that is centered above the tray could be adequate. An alternative handle arrangement could be constructed from several links of chain with a wire handle articulating with the upper link. The wire handle could be an oval with an attachment loop at the bottom, or any other shape that is comfortable to hold. With this described embodiment, a potential awkwardness would be what to do with the handle when the apparatus is at rest on a supporting surface (not being carried). If the handle is allowed to hang down, then there is a potential for interference to occur with a container resting on the tray. One solution is allowing the handle to rest on top of the extending element by articulating with a slot or ridge built into the extending element for that purpose.

Thus, the hanging tray of the invention provides a convenient spill-free method for transporting an open beverage-filled container that does not require excessive concentration to maintain a level arrangement and avoid spillage. The apparatus is small with a parsimonious design that is appropriate for an office environment where clutter is often avoided. It is the hope of the inventor that the apparatus will enable many people, particularly in office environments, to use their favorite artistic or designer cup, mug, or bowl rather than a travel container, which is often selected for utility rather than esthetics.

REFERENCES CITED 1,063,826 1913 Moyer Pan Lifter
2,946,456 1960 Liguori Multiple Tray for Baby Food 2,997,169 1961 Poupitch Container-Carrier Device 3,199,720 1965 Forman et al. Food or Beverage Carrier and Server 3,215,308 1965 Finley et al. Foldable Food and Beverage Carrier 3,908,877 1975 Kosisky Holder and Server for Beverage Cups and the Like 4,117,965 1978 Rienzo Self-Balancing Tray 5,573,136 1996 Page Pendulous Beverage Server 7,681,723 2010 Cuomo Carrier and Method US2005/0241964 Configurable Cup Holder US2005/0211578 Cup carrier 7,562,787 July 2009 Serrano Beverage Holder and Transport System US2009/0126149 Convertible Cup Holder

I claim:

1. A hanging tray apparatus for carrying a single open beverage in a hand, comprising: a tray with an upper surface on top of which a container is placed when in use; a rigid extending element which is connected to an edge of the tray and arcs outwardly from the edge of the tray to an upper position above the center of the tray, allowing the container to reside between the upper surface of the tray and the extending element directly above the center of the tray; due to the arced shape of the extending element, containers of various shapes and sizes could be accommodated by the tray; the upper surface of the tray can vary in size to accommodate a variety of container shapes and sizes, and whereby the tray upper surface has a diameter which is slightly larger than a diameter of a container base; a handle attached to a hole or other attachment means at an upper end of said extending element, said handle is mounted so that it does not interfere with the container of liquid, and whereby said handle has an opening for a plurality of fingers to be comfortably placed; and said handle being highly flexible or freely articulating.

2. Apparatus according to claim 1, wherein the hole or other means of attaching the handle to the extending element is centered above the tray, thereby allowing the tray to hang in a level orientation when bearing the weight of the container and liquid.

* * * * *